US006394642B2

(12) United States Patent
Tromley

(10) Patent No.: US 6,394,642 B2
(45) Date of Patent: May 28, 2002

(54) MIXING RESERVOIR FOR AN AUTOMATED RECIRCULATING PARTICLE SIZE ANALYSIS METHOD

(75) Inventor: Christopher K. Tromley, Ardmore, PA (US)

(73) Assignee: Microtac, Inc., Montgomeryville, PA (US)

( * ) Notice: Subject to any disclaimer, the term of this patent is extended or adjusted under 35 U.S.C. 154(b) by 0 days.

(21) Appl. No.: 09/832,473

(22) Filed: Apr. 11, 2001

Related U.S. Application Data

(62) Division of application No. 09/259,124, filed on Feb. 26, 1999, now Pat. No. 6,234,664.

(51) Int. Cl.[7] ..... B01F 5/04

(52) U.S. Cl. ..... 366/162.4; 366/136; 366/173.2

(58) Field of Search ..... 366/136, 137, 366/140, 153.1, 159.1, 162.4, 165.1, 165.5, 167.1, 173.1, 173.2, 341

(56) References Cited

U.S. PATENT DOCUMENTS

| | | | |
|---|---|---|---|
| 626,950 A | | 8/1899 | Wheelwright |
| 1,513,975 A | | 11/1924 | Eichelberger |
| 1,580,476 A | | 4/1926 | Fassio |
| 2,590,872 A | | 4/1952 | Kraft |
| 2,751,335 A | | 6/1956 | Carver et al. |
| 3,185,448 A | | 5/1965 | Fraser et al. |
| 3,306,587 A | | 2/1967 | Schroedter |
| 3,391,908 A | | 7/1968 | MacDonald |
| 3,676,075 A | | 7/1972 | Ploger et al. |
| 3,776,702 A | | 12/1973 | Chant |
| 3,833,718 A | | 9/1974 | Reed et al. |
| 3,846,079 A | | 11/1974 | Alagy et al. |
| 4,299,501 A | | 11/1981 | Patil et al. |
| 4,521,117 A | | 6/1985 | Ouwekerk et al. |
| 5,253,937 A | | 10/1993 | Scheimann et al. |
| 5,314,506 A | | 5/1994 | Midler, Jr. et al. |
| 5,439,288 A | | 8/1995 | Hoffman et al. |
| 5,609,417 A | | 3/1997 | Otte |
| 6,007,235 A | * | 12/1999 | Freud et al. |

FOREIGN PATENT DOCUMENTS

| | | |
|---|---|---|
| EP | 421265 | 4/1991 |
| FR | 1052849 | 1/1954 |
| GB | 543995 | 3/1942 |
| GB | 1060540 | 3/1967 |
| WO | 95/03120 | 2/1995 |
| WO | WO 96/14941 | 5/1996 |

* cited by examiner

*Primary Examiner*—Charles E. Cooley
(74) *Attorney, Agent, or Firm*—Wood, Herron & Evans, L.L.P.

(57) ABSTRACT

An improved mixing reservoir is disclosed used for supplying particles suspended in a liquid, in the form of a slurry, for delivery and recirculation within a recirculating system. The mixing reservoir includes an outlet port at its lowest point connected to a recirculation pump. The pump is arranged to draw the slurry from the mixing chamber and to cause a stream of the slurry to flow through the recirculating system. The improved mixing reservoir includes a plurality of inlet ports located on the mixing reservoir. Each inlet port is connected to the recirculating system and the stream of slurry, whereby the particles contained in the slurry are retained in suspension by the resulting chaotic motion of the colliding streams of slurry as they are returned to the mixing reservoir.

6 Claims, 2 Drawing Sheets

MIXING RESERVOIR FOR AN AUTOMATED RECIRCULATING PARTICLE SIZE ANALYSIS METHOD

This application is a divisional application of U.S. Pat. Application Ser. No. 09/259,124, filed on Feb. 26, 1999, and now U.S. Pat. No. 6,234,664. As noted in the transmittal papers for this application, that patent is incorporated herein by reference in its entirety.

BACKGROUND OF THE INVENTION

1. Field of the Invention

The present invention relates generally to particle size analysis apparatus and more specifically to an improved mixing reservoir used in an automated recirculating particle size analysis system.

2. Discussion of the Related Art

Automated recirculating particle size analysis systems are used to prepare a slurry by suspending the particles to be measured in a liquid and to continually stir the slurry to provide a homogenous suspension. The slurry is then continuously recirculated through an analyzer during analysis. Typically such recirculator systems utilize a mixing chamber or reservoir in which a stirring impeller is disposed to thoroughly mix the particles. The slurry with its suspended particles is pumped from the mixing reservoir to the analyzer and then returned to the reservoir. The analysis apparatus conventionally includes a sample cell where an included analysis apparatus measures the particle distribution content of the slurry. One such automated recirculating particle size analysis system is disclosed by U.S. Pat. No. 5,439,288 to Jeffrey G. Hoffman et al., and which is now assigned to the same assignee as the present invention.

It is of vital importance in such systems that the distribution of the particles in the slurry in the sample cell be representative of the entire statistical population to ensure valid data collection for analysis.

In apparatuses that measure particle size in the micron particle size ranges of less than 100 microns, even the densest materials disperse uniformly throughout the fluid and provide a uniform slurry. However, particles in the size range between 100 to 1000+ microns have movement that tends to become more independent of the fluid. When the slurry is reintroduced to the mixing reservoir for recirculation, the large dense particles tend to fall straight to the exit port. Since large particles are under-represented in the mixing tank, they are over-represented in the sample cell of the measuring apparatus, therefore, developing a non-uniform distribution of particles within the recirculating apparatus. This non-uniform distribution does not accurately represent the statistical population of particles in the slurry.

Prior art methods for keeping large particles in suspension in the reservoir tank included the use of high-speed impellers for shifting and directing the particles away from the reservoir outlet and/or directing the return flow against a deflecting surface so as to deflect the returning particles into the larger volume of the reservoir. Such prior art devices have been found to have drawbacks in that the impeller typically introduces excess turbulence and bubbles within the reservoir due to the speed of the impeller and its propensity to cause cavitation in the fluid. Additionally, the larger delicate particles may be broken into smaller pieces when battered against hard surfaces during injection onto deflecting surfaces and, therefore, not correctly represent the particle size distribution found in the manufacturing process.

BRIEF SUMMARY OF THE INVENTION

It is, therefore, an object of the present invention to provide an improved mixing reservoir that maintains a uniform distribution of large dense particles within a slurry.

It is also an object of the present invention to provide an improved mixing reservoir that maintains a uniform distribution of particles in suspension without the aid of mechanical devices such as motor driven impellers or other high vortex inducing devices.

In carrying out the objects of the invention, there is provided an improved mixing reservoir for supplying particles suspended in a liquid, to form a slurry, for delivery and recirculation within a recirculating system. The mixing reservoir includes an outlet port at its lowest point connected to a recirculation pump. The pump is arranged to draw the slurry from the mixing chamber and to cause a stream of said slurry to flow through the recirculating system. The improved mixing reservoir includes a plurality of inlet ports located on the mixing reservoir with each inlet port connected to the recirculating system and the stream of slurry, whereby the particles contained in the slurry are retained in suspension by the resulting chaotic motion of the colliding streams of slurry as they are returned to the mixing reservoir.

BRIEF DESCRIPTION OF THE SEVERAL VIEWS OF THE DRAWINGS

Other objects, features, and advantages of the present invention will be apparent from the following description of a preferred embodiment thereof, taken in conjunction with the sheets of drawings, in which.

DETAILED DESCRIPTION OF THE INVENTION

Figure 1:
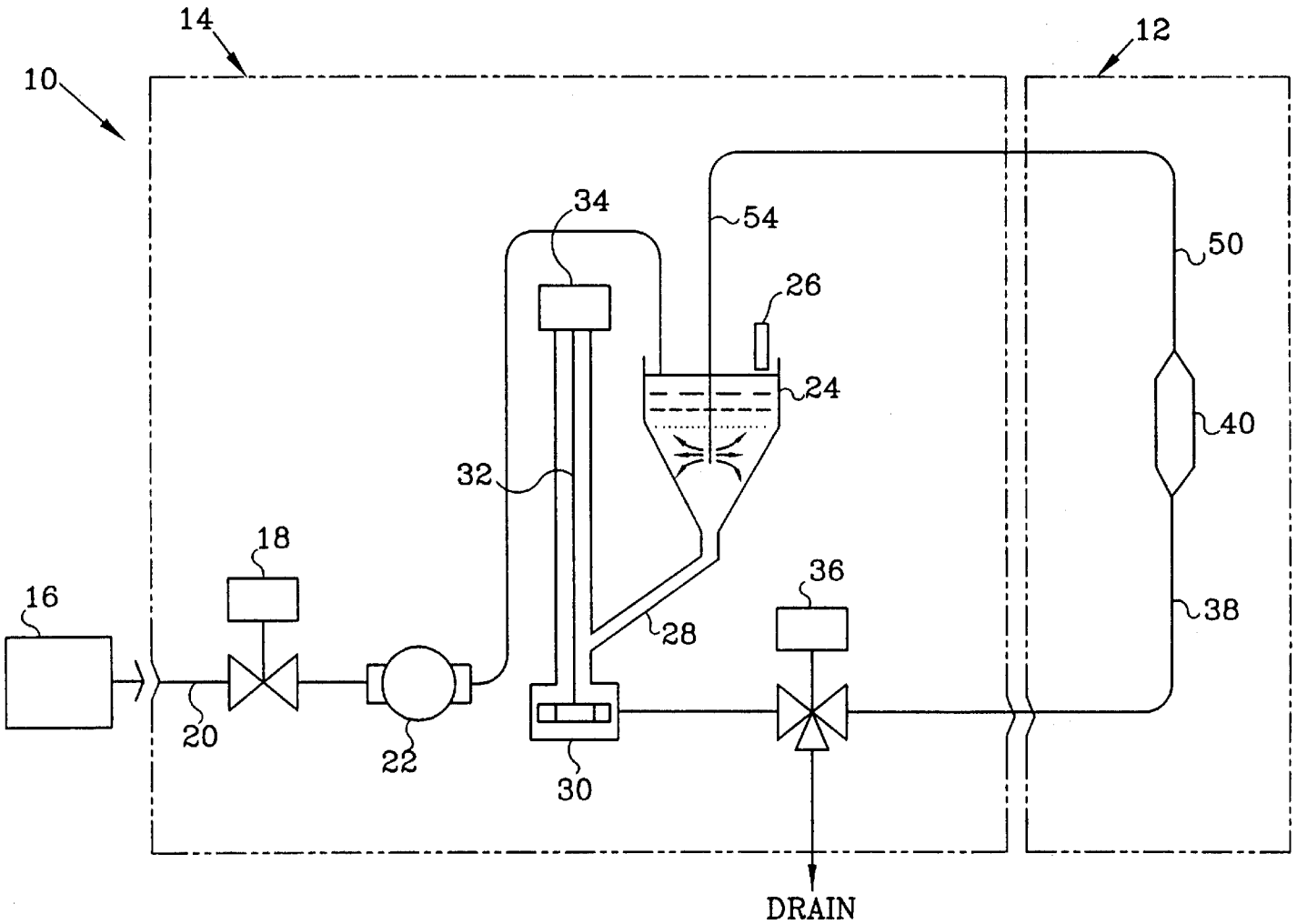
Fig.1 (PRIOR ART)
FIG. 1 is a schematic view of a prior art automated recirculating particle size analysis system, including a prior art mixing reservoir, where the present invention may be used to advantage.

Referring now to FIG. 1 there is shown a prior art automated mixing and recirculating system of the type contemplated to be used with the present invention. The system 10 consists of a measurement module 12 and a flow system module 14. The flow system module 14 is fed by a customer's fluid supply 16. The results of the analysis provided by the measurement module 12 may be used to control a process from which the particles under analysis were taken. An electrically actuated valve 18 disposed in the inlet line 20 controls flow to the flow system and particularly to the transfer pump 22. The outlet of the transfer pump 22 is connected to a mixing reservoir or tank 24 which, in this prior art embodiment, is cylindrical and disposed with its axis thereof in a generally vertical orientation.

The transfer pump 22 is controlled by a level sensor 26 that limits the maximum height of the fluid in the mixing tank 24. The mixing tank 24 has an outlet 28 at the lower extremity thereof which connects to a centrifugal pump 30. The pump 30 is driven by an elongated shaft 32 coupled to a variable speed pump motor 34. The output of pump 30 is directed to a circulate/drain valve 36. This valve 36 permits the alternate draining of the slurry for testing of another sample or passage of the slurry to a measurement module and specifically to the measurement module 12. The flow of slurry from valve 36 to the input side of sample cell 40 is by means of tube 38. The slurry contained in sample cell 40 and representing a representative sample of the particles of the manufacturing process is measured by any particle measurement method or technique (not shown) currently known. The slurry flows from the sample cell 40, into tube 50 and out of the measurement module 12 and back into the flow system 14 to mixing tank 24 via tube 54. The end of tube 54 terminates in a conical-shaped lower end of the mixing tank 24. The return slurry is injected into the tank 24 via a set of holes at the end of the tube 54. The slurry reintroduced into the tank is directed to the conical sides of the tank and is then deflected upward toward the cylindrical volume of the tank. A better understanding of the system just described may be had by reference to U.S. Pat. No. 5,439,288, to Jeffrey G. Hoffman et al., and which is now assigned to the same assignee as the present invention and which is incorporated herein by reference.

The present invention discloses a new and improved mixing tank for the mixing tank 24 shown in FIG. 1.

Figure 2:
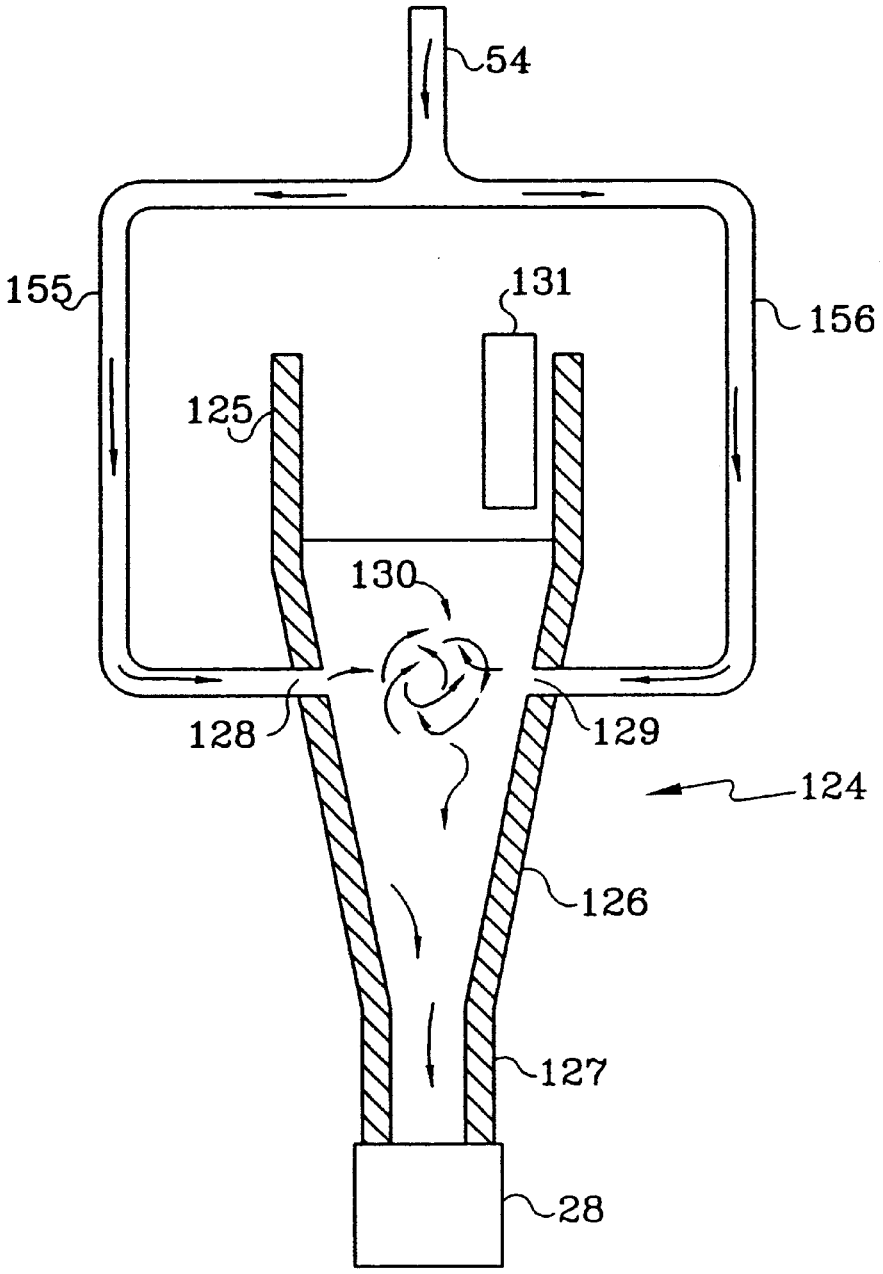
FIG. 2 is a sectional view taken through the vertical plane of the improved mixing reservoir in accordance to the present invention.

Turning to FIG. 2., the improved mixing tank 124 of the present invention includes a generally cylindrical upper portion 125 arranged about a central vertical axis leading into a generally elongated conical lower portion 126. The outer walls of the conical portion 126 taper inwardly to terminate at an outlet port 127 that is connected to tube 28 and which connects to pump 30 as shown in FIG. 1. The liquid level of tank 124 is controlled by a liquid level sensor 131 that controls the introduction of fluid from the fluid supply 16.

Tube 54 is connected to a first end of a pair of feeder tubes 155 and 156. A second end of tube 155 is connected to an inlet port 128 located on the conical portion 126 of the tank 124. The second end of tube 156 is connected to a second inlet port 129, also located on the conical portion 126 of tank 124 directly opposite inlet port 128. The inlet ports 128 and 129 are generally co-extensive with the conical-shaped sides of the mixing tank 124 as seen in FIG. 2. Returned slurry conveyed by tube 54 is split into two streams, each flowing within respective tube 155 and 156 to inlet ports 128 and 129 respectively. The two fluid streams are introduced into the interior of conical portion 126, directly opposite of each other.

The resulting chaotic motion of the colliding streams forms a mixing region 130 within tank 124 between inlet ports 128 and 129 that keeps large dense particles suspended uniformly. It should be noted, that it is not a strict requirement to locate inlet ports 128 and 129 directly opposite, or axially aligned with each other as shown in FIG. 2. The axial alignment is shown as to better understand the invention. It is, however, important that no matter how the ports 128 and 129 are placed in conical portion 126, the streams of slurry flowing from each port collide to form the mixing region 130 within tank 124.

The uniformly mixed slurry is then drawn from tank 124 via outlet port 127 to tube 28 by pump 30 to be conveyed to the sampling cell 40 of the measurement module 12. The narrowing conical shape of conical portion 126 preserves the uniformity of the mixed slurry and minimizes any possible stagnant mixing areas that may develop in tank 124.

The improved mixing tank of the present invention, therefore, discloses a novel apparatus that can be used whenever a fluid/particulate stream is introduced into a tank and it is desired to keep the particulate dispersed uniformly within a slurry. The mixing is accomplished by directing streams of returning slurry at each other to form a mixing region where the particles are kept in suspension by the chaotic motion of the colliding streams.

Even though the description of the present invention has been made to the advantage it derives from its use in slurries containing large dense particles, it will be understood by those skilled in the art that the apparatus just described can be equally and effectively applied to the mixing of smaller particles of less than 100 microns and is not limited thereto.

The present invention has been described with particular reference to the preferred embodiments thereof. It will be obvious that various changes and modifications can be made therein without departing from the spirit and scope of the invention as defined in the appended claims.

What is claimed is:

1. An improved method of analyzing the particle sizes within a slurry containing particles suspended in a liquid, the method comprising:

a) containing a slurry within a mixing reservoir coupled within a recirculating system, the mixing reservoir having conical-shaped sides leading to an outlet port;

b) pumping the slurry through the recirculating system with a pump coupled to the outlet port, the outlet port positioned proximate a low point of the mixing reservoir and the pump operable to draw said slurry from said mixing reservoir and to maintain a stream of said slurry flowing through said recirculating system;

c) in the recirculating system, dividing the stream of slurry to define multiple slurry streams for directing back into the mixing reservoir;

d) directing each of the multiple streams of slurry into the mixing reservoir through respective inlet ports located in the conical-shaped sides of the reservoir directly opposite each other and making the incoming slurry streams directly collide with each other in a mixing region between the conical-shaped sides of the reservoir and thereby imparting chaotic motion to the particles in the slurry and keeping the large particles suspended for a period of time within the mixing region before falling to the outlet port;

whereby said large particles are retained for a longer period of time in suspension within said mixing reservoir by the resulting chaotic motion of the colliding streams of slurry for a more accurate particle size analysis of the slurry.

2. The method of claim 1 further comprising pumping the stream of slurry to a sample cell in the circulating system for performing particle measurement prior to dividing the stream of slurry to define multiple slurry streams.

3. The method of claim 1 further comprising maintaining a slurry in the mixing reservoir having large particle sizes of 100 microns and above.

4. The method of claim 1 further comprising maintaining a slurry in the mixing reservoir having large particle sizes of 1000 microns and above.

5. The method of claim 1 further comprising dividing the stream of slurry to define multiple slurry streams by directing the slurry through a tube of the recirculating system and coupling the tube to multiple feeder tubes.

6. The method of claim 1 wherein said inlet ports are generally co-extensive with the conical-shaped sides of the mixing reservoir.

* * * * *